US005613351A

United States Patent [19]

Hamers et al.

[11] Patent Number: 5,613,351

[45] Date of Patent: Mar. 25, 1997

[54] SEPARATING APPARATUS FOR SEPARATING PACKAGED PRODUCTS IN A PACKAGING APPARATUS

[75] Inventors: Ludovicus W. A. Hamers, Westzaan; Roberto Tuyn, Zaandam, both of Netherlands

[73] Assignee: Buhrs-Zaandam B.V., Zaandam, Netherlands

[21] Appl. No.: 494,298

[22] Filed: Jun. 23, 1995

[30] Foreign Application Priority Data

Jun. 27, 1994 [NL] Netherlands ..... 9401064

[51] Int. Cl.[6] ..... B65B 9/20; B65B 61/06; B65B 61/12

[52] U.S. Cl. ..... 53/55; 53/389.3; 53/389.5

[58] Field of Search ..... 53/550, 450, 389.3, 53/389.5, 551

[56] References Cited

FOREIGN PATENT DOCUMENTS 2182867 12/1973 France .
2851894 6/1980 Germany .
574844 3/1976 Switzerland .

*Primary Examiner*—Horace M. Culver
*Attorney, Agent, or Firm*—Griffin, Butler, Whisenhunt & Kurtossy

[57] ABSTRACT

A separating apparatus for separating packaged products in a packaging apparatus, wherein, in operation, a continuously fed strip of packaging material of synthetic material is folded around a series of products to form a sleeve, wherein in the product conveying direction the folded-over sides are interconnected by means of longitudinal connection means to form a longitudinal connection, wherein, in the transverse direction between two separate products (2, 2'), the upper and lower sides of the sleeve are interconnected by means of cross connection means to form a cross connection, whereupon the thus packaged products are separated over a separating line extending at the location of the cross connection. The separating apparatus (12) is a conveyor (13) which, viewed in the direction of travel, is arranged behind the cross connection means on one side, preferably the lower side of the continuously fed packaging strip, and comprises carrying means (14) for periodically gripping and accelerating a packaged product (2') relative to a following product (2).

5 Claims, 1 Drawing Sheet

SEPARATING APPARATUS FOR SEPARATING PACKAGED PRODUCTS IN A PACKAGING APPARATUS

Figure 1:
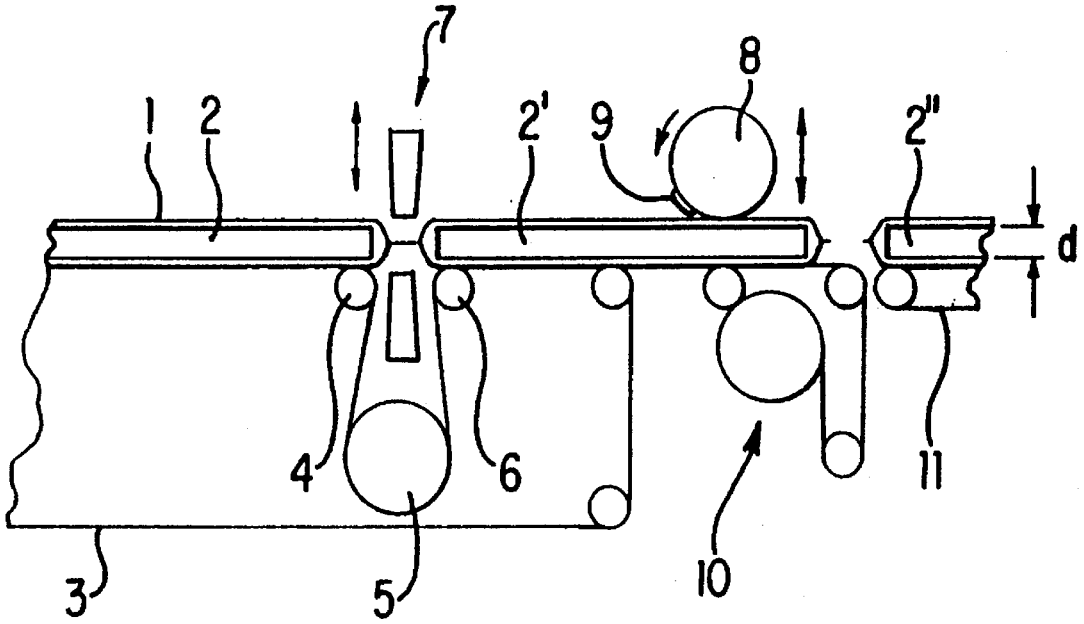

The invention relates to a packaging apparatus according to the preamble of claim 1.

Such a packaging apparatus is known from NL-B-186.954. In this NL-B, a packaging apparatus is described wherein the packaging sleeve is heated between two products over a particular width, subsequently two cross connections are provided in the heated part by means of pressure, and, finally, the sleeve is cut through between the two cross connections by means of two cooperating cutters to form separately packaged products.

From practice it is known to replace the cutting apparatus from the packaging apparatus by a separating apparatus in the form of a separating wheel whose periphery is locally provided with a raised portion. This wheel is arranged above the packaging sleeve and set and aligned so that immediately after the packaging sleeve has been heated in the transverse direction, the raised portion engages a packaged products. Because the peripheral velocity of the wheel is greater than the speed of the packaging sleeve with products, the wheel periodically pulls at a packaged product and the packaging sleeve is severed between the two cross connections provided. Moreover, it has appeared that this does not require any prior formation of separate cross connections through the local application of pressure. The packaging sleeve is heated between two products in the transverse direction at one point until the synthetic material melts locally. The packaging sleeve can now easily be severed at that location. After the severance of the locally heated packaging sleeve, the synthetic material solidifies, causing the package to close by itself in the transverse direction and producing an entirely closed package. In this manner, the provision of the two cross connections is effected with the separating step in one working stroke.

A drawback of the known separating wheel is that in order to be able to engage the packaging sleeve, the raised portion slightly impresses a packaged product locally and this product can thereby be damaged. The increasing speed of the packaging apparatuses causes the danger that the longitudinal connection has not yet cooled down completely when the wheel is pressed against a packaged product. The longitudinal connection lies on the same side of the products as the separating wheel and as a consequence, the package on the longitudinal connection can be pressed down on the product. It is no longer possible to remove such a product from the package undamaged. In addition, the wheel should be set at the correct height for each thickness of the product to be packaged. This is particularly undesirable if stacked products, whose composition may differ per stack, should be packaged. FR-A-2 182 867 shows a packaging apparatus wherein a product received in a sleeve is pulled loose from the following stream of products through engagement of accelerating wheels with both the upper and the lower side of the product. This known apparatus has the same drawbacks as the above-described separating wheel. DE-A-2 851 894 discloses an apparatus wherein pin-feed papers are separated by a separating apparatus that engages the paper from one side only. In this separating apparatus, however, a pressure plate is used which presses the paper against the separating wheel. Suppose that products of a certain thickness had to be separated in a similar manner, the pressure plate would then in each case have to be set at a particular height. Moreover, in this known apparatus the product is provided with special features (pin holes) to effect a positive engagement between the separating wheel and the pin-feed papers.

The object of the invention is to provide a separating apparatus that does not have the above-mentioned drawbacks.

To that end, the separating apparatus according to the invention exhibits the features of claim 1.

Because the packaged products are periodically gripped and accelerated in the product conveying plane from one side only, preferably the lower side, an adjustment of the separating apparatus to the thickness of the products to be packaged has become redundant. Also, in this manner the longitudinal connection formed at the upper side is not pressed against the product and hence, the longitudinal connection can no longer become stuck on the product. In addition, the packaged products are gripped by the carrying means almost throughout the length of the conveyor, which highly reduces the changes of damaging.

In accordance with a preferred embodiment, the packaging apparatus is characterized by the features of claim 2. By a packaging apparatus of such design, the packaging sleeve is gripped over a relatively large portion. As a result, only the packaging sleeve is pulled at and the packaged products cannot be damaged.

Figure 2:
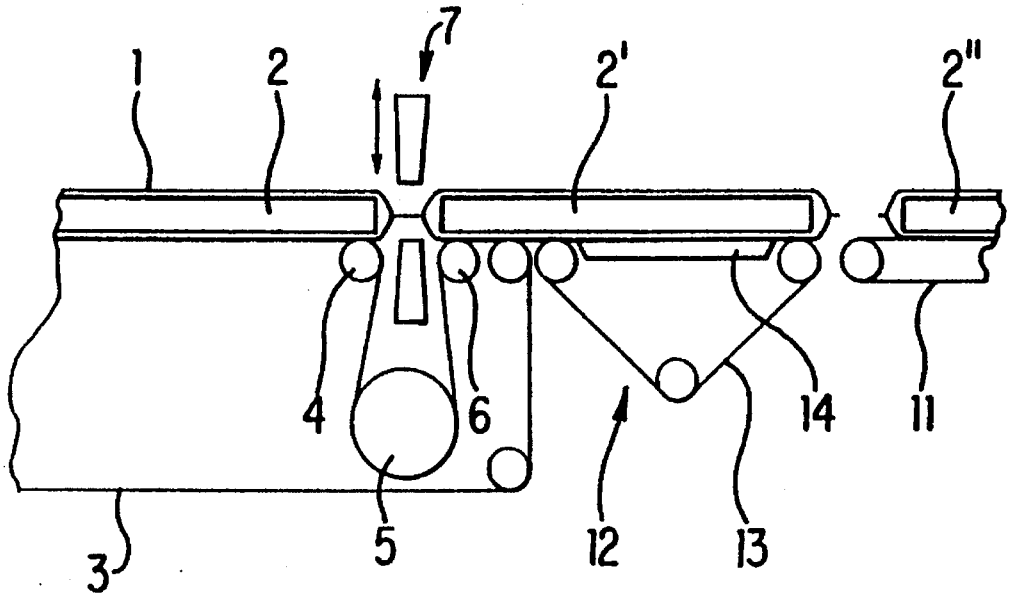

Further elaborations of the invention are described in the subclaims and will be further explained hereinafter on the basis of an embodiment of a packaging apparatus according to the invention and with reference to the accompanying drawing. In this drawing:

FIG. 1 shows a schematic side elevation of a known separating apparatus in a packaging apparatus, in the form of a wheel whose periphery is locally provided with a raised portion; and FIG. 2 shows a schematic side elevation of a separating apparatus according to the invention in a packaging apparatus.

FIG. 1 shows a portion of a packaging apparatus known from practice. In a portion of the packaging apparatus upstream thereof, not shown, a strip of synthetic packaging material has already been folded around a series of products 2, 2', 2" to form a sleeve 1. The folded sides of the packaging strip are attached to each other by means of longitudinal connection means (not shown), forming a longitudinal connection. The products 2 thus packaged in the packaging sleeve 1 are moved along by means of a first conveyor 3. The conveyor belt of this conveyor 3 is locally deflected from the product conveying plane via reversing rollers 4,5,6. Thus, room is created for cross connection means 7 in the form of a heating element 7 arranged under and above the packaging sleeve 1. These two heating elements 7 are moved toward one another between every two successive products 2, 2'. As a result, the upper and lower sides of the packaging sleeve 1 are locally heated and secured to one another in the transverse direction. After the cross connection means 7, the packaging apparatus comprises a separating wheel 8 whose periphery is provided with a local raised portion 9. The peripheral velocity of this separating wheel 8 is higher than the speed of the packaging sleeve 1 on the conveying device 3. Directly after the heating elements 7 have been moved apart again, the raised portion 9 of the separating wheel 8 engages a packaged product 2' that has just passed the heating elements 7. As a result, this product 2' is accelerated in the direction of travel. Because the packaging sleeve 1 between this product 2' and the following product 2 has just been heated and has not yet solidified, the packaging sleeve 1 is severed in the transverse direction at this location. The material heated in the transverse direction solidifies and accordingly, a separate, completely packaged and sealed product 2" is obtained.

A drawback of the known apparatus is that the separating wheel 8 should priorly be set to the thickness d of the products 2, 2', 2" to be packaged. For a proper engagement of the separating wheel 8, a counter wheel is arranged opposite this wheel at the lower side of the packaging sleeve 1, which counter wheel forms part of a second conveying device 10. The separately packaged products 2" are transferred to and further conveyed by a third conveyor 11.

Another drawback of this separating wheel 8 is that to enable the packaging sleeve 1 to be engaged, the raised portion 9 slightly impresses a packaged product 2' locally and this product 2' can thereby be damaged. The increasing speed of the packaging apparatuses involves the risk that the longitudinal connection has not yet cooled down completely when the wheel 8 is pressed against a packaged product 2'. The longitudinal connection lies on the side of the products with which the separating wheel 8 engages, as a consequence of which the package on the longitudinal connection can be pressed down on the product 2'. It is no longer possible to remove such a product from the package undamaged. This is particularly undesirable if stacked products, whose composition may differ per stack, have to be packaged.

FIG. 2 shows an embodiment of a separating apparatus 12 according to the invention. For corresponding parts the same reference numerals are used as in FIG. 1.

The separating appratus 12 is formed by a conveyor 13 which is preferably arranged under the packaging sleeve 1 and which comprises carrying means 14. These carrying means 14 periodically grip one side of the packaging sleeve. Through simultaneous periodical acceleration of the conveyor 13 relative to the conveying device 3 disposed directly upstream thereof, the packaging sleeve is periodically pulled at. As a result, the packaging sleeve 1 is severed at the cross connection, not yet solidified, and a separately packaged product 2" is obtained.

Because the packaged products 2' are periodically gripped and accelerated in the product conveying plane from the lower side, an adjustment of the separating apparatus 12, 13 to the thickness d of the products to be packaged has become redundant. Also, in this manner the longitudinal connection formed at the upper side is not pressed against the product 2' and hence, the longitudinal connection can no longer become stuck on the product 2'. In addition, the packaged products are gripped by the carrying means 12 almost throughout the length of the conveyor, which highly reduces the changes of damaging.

In accordance with a preferred embodiment, the conveyor 13 comprises at least one conveyor belt having openings and a vacuum device 14 disposed under the conveyor belt openings for periodically fixing a portion of the packaging sleeve 1 on the conveyor belt 13 through suction. By a separating apparatus 12 of such design, the packaging sleeve 1 is gripped over a relatively large portion. As a result, only the packaging sleeve 1 is pulled at and the packaged products 2' cannot be damaged.

The second conveyor 13 is preferably provided with a control mechanism and drive means, arranged for both decelerating and accelerating the conveyor. By decelerating the conveyor 13 temporarily, the distance between a product located on the second conveyor and a following product 2' or 2 is temporarily reduced so that the tension in the sleeve packaging material is removed, permitting at that location the upper and lower sides of the sleeve to be moved toward each other more easily by the cross connection means 7 to form a cross connection.

Preferably, the control mechanism and the drive means of the second conveyor 13 are so designed that the moment when and the extent to which the second conveyor 13 is accelerated are settable. With such a control the cooling-down time of the cross connection weld can be set. This is of great importance because too short a cooling-down time leads to fray formation or the formation of threads and too long a cooling-down time has as a result that the packages are no longer separated from one another or at least not separated at the location of the cross connection, as a consequence of which at least one of the packages is no longer sealed.

It is understood that the invention is not limited to the above-described exemplary embodiment. For instance, the vacuum device can be excited continuously and the speed of the second conveyor can be varied for separating the products from each other. On the other hand, however, the second conveyor may also have a constant speed, with the vacuum device being excited periodically, so that the preceding product P is only pulled at by the second conveyor at the moment when the vacuum device is excited, and when the vacuum device is not excited slip occurs between the preceding product P' and the second conveyor.

We claim:

1. A packaging apparatus comprising packaging material feed means for feeding a continuous strip of packaging material, sleeve-forming means for folding the continuous strip of packaging material into a sleeve, product feed means for feeding the products to be packaged into the sleeve, longitudinal connection means for interconnecting, by means of a longitudinal connection, the longitudinal sides of the material strip formed into a sleeve, cross connection means for interconnecting, by means of a cross connection, the upper and the lower layer of the sleeve, and a separating apparatus for separating the products from each other at the location of a formed cross connection to obtain separately packaged products, the apparatus comprising at least a first conveyor for feeding the products received in the sleeve to the separating apparatus, the separating apparatus being characterized by a second conveyor (13) downstream of the cross connection means (7), said second conveyor (13) engaging only one side of the products (2'), the second conveyor (13) comprising carrying means (14) for periodically accelerating a packaged product (2') relative to a following product (2), the arrangement being such that the packaging sleeve (1) is severed at the location of the cross connection to obtain a separately packaged product (2").

2. A packaging apparatus according to claim 1, characterized in that the second conveyor (13) comprises at least one conveyor belt (13) having openings and a vacuum device (14) arranged under the conveyor belt openings for fixing a portion of the packaging sleeve (1) on the conveyor belt (13) through suction.

3. A packaging apparatus according to claim 1, characterized in that the second conveyor (13) is provided with a control mechanism and drive means, arranged for both decelerating and accelerating the conveyor (13).

4. A packaging apparatus according to claim 1, characterized in that the second conveyor is provided with a control mechanism and drive means so designed that the moment when and the extent to which the second conveyor (13) is accelerated are settable.

5. A packaging apparatus according to claim 1 in which the only one side of the products (2') engaged is the side that faces away from the longitudinal connection.

* * * * *